United States Patent [19]

Brewer

[11] 4,082,232

[45] Apr. 4, 1978

[54] SHREDDER STRUCTURE

[75] Inventor: John C. Brewer, Salt Lake City, Utah

[73] Assignee: Garbalizer Corporation of America, Salt Lake City, Utah

[21] Appl. No.: 773,854

[22] Filed: Mar. 3, 1977

[51] Int. Cl.[2] ..... B02C 13/28

[52] U.S. Cl. ..... 241/236; 83/665; 308/163; 403/358

[58] Field of Search ..... 241/32, 236, 243; 83/665; 29/104; 90/11 B; 51/168; 403/261, 344, 356, 358, 409; 74/230.3, 230.11, 230.13, 450; 29/159 R, 159.3, 157.3 A, 416, 463; 308/27, 30, 163

[56] References Cited

U.S. PATENT DOCUMENTS

| | | | |
|---|---|---|---|
| 1,419,407 | 6/1922 | Pardee | 241/32 |
| 1,444,035 | 2/1923 | Penning | 83/665 |
| 2,552,166 | 5/1951 | Gardiner | 308/163 |
| 2,919,075 | 12/1959 | Pfeiffer | 241/32 |
| 2,973,979 | 3/1961 | Musser | 403/358 |
| 3,159,047 | 12/1964 | Dable | 403/344 |
| 3,578,252 | 5/1971 | Brewer | 241/243 |
| 3,845,907 | 11/1974 | Schwarz | 241/236 |
| 3,893,635 | 7/1975 | Brewer | 241/243 |
| 3,931,935 | 1/1976 | Holman | 241/236 |
| 3,951,346 | 4/1976 | Brewer | 241/32 |

*Primary Examiner*—Granville Y. Custer, Jr.

[57] ABSTRACT

A shearing or shredding construction incorporating a revolvable shaft that is grooved for the reception of a series of mutually-spaced blades, and wherein keys accurately and positively position such blades, such structure being provided with close tolerance bearings for severely restricting if not eliminating a shifting of the rotor shaft along its axis.

9 Claims, 8 Drawing Figures

SHREDDER STRUCTURE

FIELD OF INVENTION

The present invention relates to shredding and shearing constructions for reducing municipal debris, garbage, tires, and other waste products and, more particularly, provides improved, inexpensive rotor make-up and means whereby close tolerances may be had and maintained as to the shearing blades of the rotor and the cutter bars with which they cooperate.

DESCRIPTION OF PRIOR ART

In the past there have been a number of types of rotor constructions incorporating shearing or cutting blades. One conventional approach that has been taken heretofore consists of simply mounting mutually-spaced blades on a shaft and incorporating annular spacers between the blades. Such an approach, however, results in a build up of tolerances and an accumulation of errors, this owing to slight machining tolerances as between the cutter blades and their interspacing.

Another approach that has been taken is illustrated in the inventor's U.S. patent which follow:

U.S. Pat. Nos. 3,840,187, 3,893,635, 3,708,127, 3,951,346, 3,762,655.

Such patents incorporate a respective hub on the shaft for each blade, the hub allowing for blade slippage where overload is present. Such a construction as illustrated in the above patents has operated unusually well. However, there is a matter of expense in machining and supplying these hubs for low-cost units.

It has occurred to the inventor that such expense could be materially reduced were the shaft actually machined to provide a series of blade-receiving and mounting grooves. However, where such is employed with discretely set, cooperating cutter bars, especially, some means would have to be provided for precluding shift of the shaft along its axis other than the usual, load-carrying journal bearings. Such shift, of the order of 0.005–0.010 inches minimum is currently experienced, whatever type of end bearings are employed to support the rotor.

BRIEF DESCRIPTION OF THE INVENTION

In the present invention, the rotor shaft includes not only support bearings, but also accurately set thrust bearing surfaces to preclude lateral shift. These take the form of bearing segments or portions that are milled or ground, for example, and secured proximate end plates of the shredder housing. These surfaces are the last to be provided the structure, with appropriate bearing half supports last installed, so as to precude, finally, any shifting that would otherwise be allowed by the usual bearing supports, normally pillow-block bearings.

The shaft itself is machined to provide cooperating thrust-bearing engagement surfaces and also a series of mutually spaced grooves within which the blades are mounted. The blades themselves take the form of blade segments that are secured about the shaft, providing for easy blade-removal from a shaft without disturbing other blade mountings, should a blade be defective after some running experience. The grooves in the shaft are tapered to facilitate blade placement and substantially exact fit. Such fit is finalized in the design of blade keys that exactly align the blade relative to keyways that are mutually helically oriented about the shaft. The latter provision is made to accommodate helical placement of the blade configuration as well as preserve a maximum of shaft strength. In the shredder construction, overload provision is supplied, exterior to the shredder proper, as is contrasted with prior overload release relative to each blade on the prior-used hub, see the abovementioned patents.

OBJECTS

Accordingly, a principal object of the present invention is to provide new and improved shredding and/or shearing structure.

A further object is to provide a shaft having a series of grooves designed to receive cutting, shearing or shredder blades.

A further object is to provide shredder structure where the shaft is held against any inadvertent shifts along its axis.

A further object is to provide a precision shredder wherein close tolerances can be held between blades and also relative to blades and the cutter bar configurations through which the blades pass.

A further object is to provide an improved shaft-blade combination wherein blades are held exactly in position on the shaft.

A further object is to provide a shredder having overload means disposed between the shredder and its drive.

An additional object is to provide an improved blade construction.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF PREFERRED EMBODIMENTS

Figure 1:
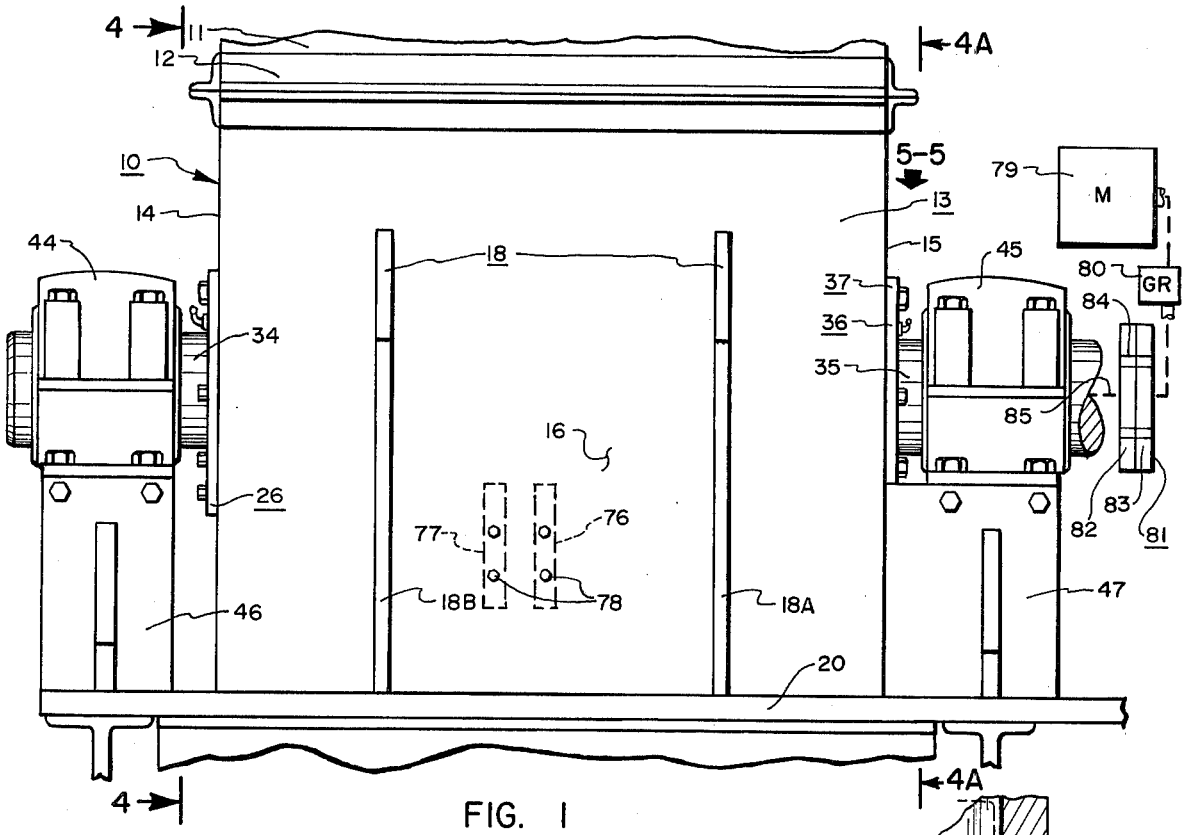
FIG. 1 is a side elevation of a shredder incorporating the principles of the present invention.

In the drawings, the shredder 10 includes a conventional hopper 11 which is secured by angle iron frame 12 to shredder housing 13. Housing 13 includes end walls 14 and 15 and side walls 16 and 17, the latter two being supported by upright brace pairs 18 and 19. Each of the pairs of braces 18A, 18B and the corresponding braces of brace pair 19 is supported on respective base member 20 and 21 which in turn are supported by beams 22 and 23.

Figure 4:
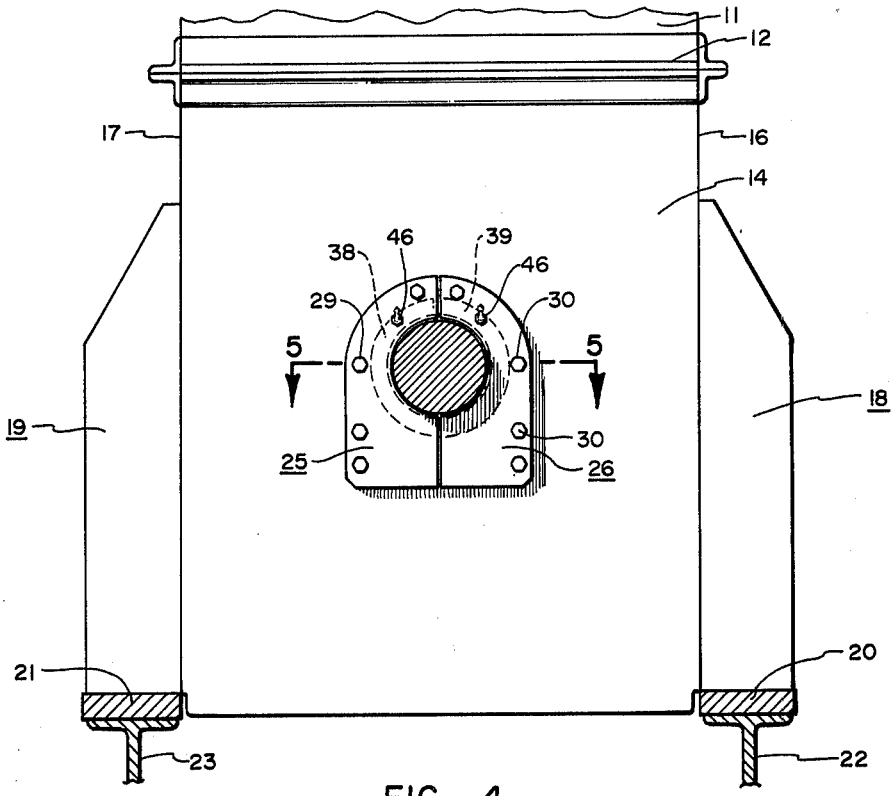
FIG. 4 is a view taken along the vertical line 4—4 in FIG. 1, and is partially shown in section; it will be understood that this section along the line 4A—4A in FIG. 1 will be identical.

FIG. 4 illustrates a typical end wall of a housing, e.g. end wall 14 which includes wall aperture 24 enclosed by bearing support halves 25 and 26. These halves include bolt apertures 27 and 28 which receive bolts 29 and 30, see FIG. 5, for threaded engagement with threaded apertures 31 and 32 of each of the respective end walls 14,15. The shredder shaft 33 includes a turned-down end portion 34, and also end portion 35, which proceeds through the bearing support halves 25,26 and indentical halves 36,37 at the opposite end wall 15.

Each of the bearing support halves include a respective bearing 38,39, the bearing surfaces 40 and 41 of which are milled or ground to provide positionment surfaces to strictly limit the positioning of shaft 33. Such surfaces engage surface 42 of annular abutment portion 43 of the shaft 33 which extends peripherally thereabout, being a machined portion. Corresponding portions 43 with their bearing engagement surfaces 42 are found at opposite extremities or portions of the shaft to engage the respective bearings 38,39, at each end wall 14,15.

The shaft ends, 34,35, are carried by respective pillow-block bearings 44,45, each of which is mounted on respective bearing support structure 46 and 47. Such bearing support structure is secured in place by welding or any conventional means to the base members 20,21 of FIGS. 1 and 4.

Figure 3:
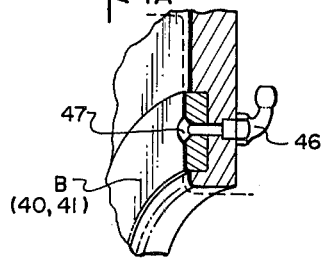
FIG. 3 is a fragmentary perspective detail indicating a lubrication means for the bearing segments supplied the bearing end plates associated with the shredder housing.

Each of the bearings 38,39, at each end of the shaft, may be provided with a lubricant fitting 46 that is in communication, via aperture 47, with the bearing surface B of each bearing half 38,39. Such bearing surface B is illustrated in FIG. 3 and comprises a respective surface 40,41 of each of the bearing halves at each end of the shaft.

Figure 6:
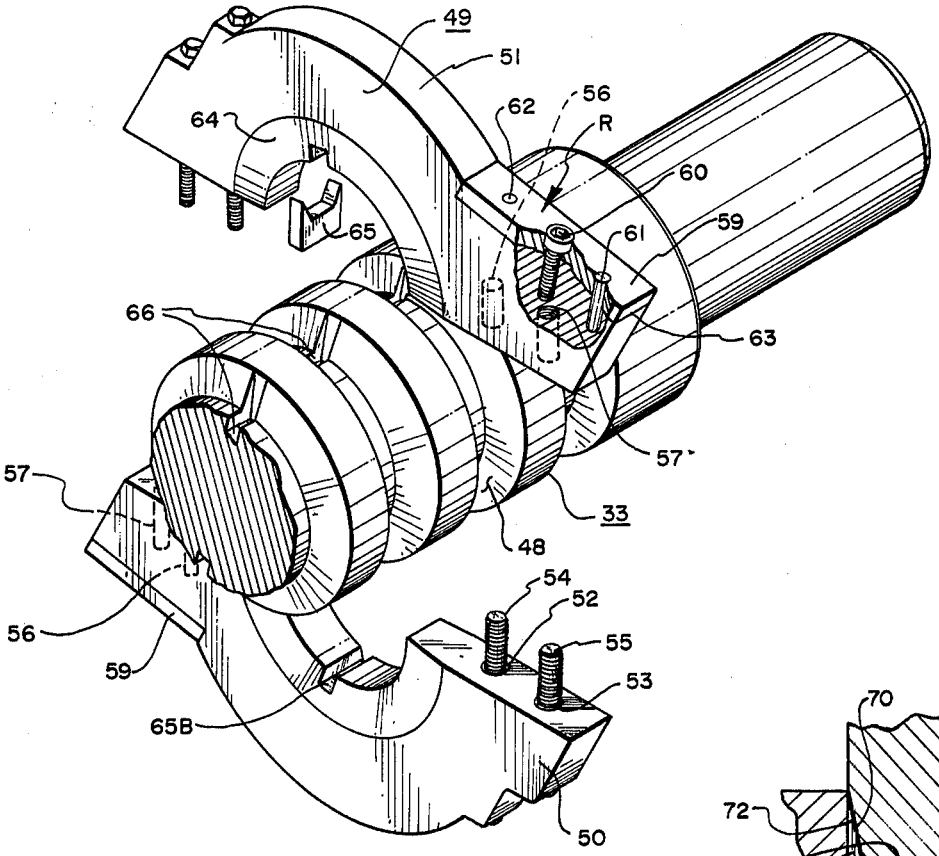
FIG. 6 is a fragmentary perspective of a shredder shaft illustrating representative blade halves being ready for mounting to the shaft, whereby to form a representative shredder blade.
Figure 7:
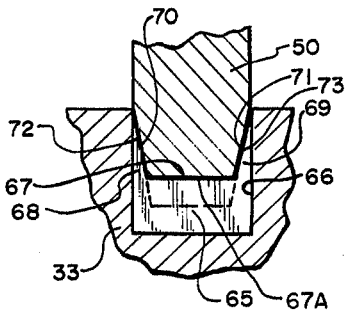
FIG. 7 is an enlarged, fragmentary detail illustrating the manner and means by which each blade half is keyed to the shredder shaft.

Shaft 33 itself is provided with a series of tapered grooves 48 which are mutally spaced. Each groove receives a blade 49 which preferably comprises identical, interchangeable, opposite blade halves 50 and 51. Each of these are provided with a series of apertures 52,53 for receiving bolts 54,55. These are threaded into threaded apertures 56,57, in the opposite blade half. The hardened steel or other insert 59 is secured by machine screw 60 and pins 61,62 to each respective blade half at its shearing portion insert seat 63. The inner periphery 64 is inwardly tapered so as to assist an insertion of each blade half in a respective groove 48. Key 65 is a representative one of a series of keys respectively inserted into a respective key slot 66 contiguous with each groove 48. The key slots are helically arranged, as indicated in FIG. 6, so that each blade half may be fabricated in exactly the same manner. Also, this increases the strength of the shaft by staggering such key slots. A representative key 65, see FIG. 7, includes a concave tapered slot 67, as defined at its end by upstanding, tapered leg portions 68 and 69. Surfaces 70 and 71 formed thereby exactly position the blade by virtue of these outwardly diverging side wall surfaces engaging corresponding surfaces 72 and 73 of the representative blade half 50, for example, in the region of the key at convex portion 67A of blade keyway 65B registering with slot or recess 66.

Accordingly, a slight clearance may be provided for the insertion of each blade half, and this is aided by the tapered margins at 64 on opposite sides of each blade half. The exact positionment of the blade is assured by the abutment of the shaft-groove walls, and can be aided by virture of the orientation and configuration of the key used.

Figure 8:
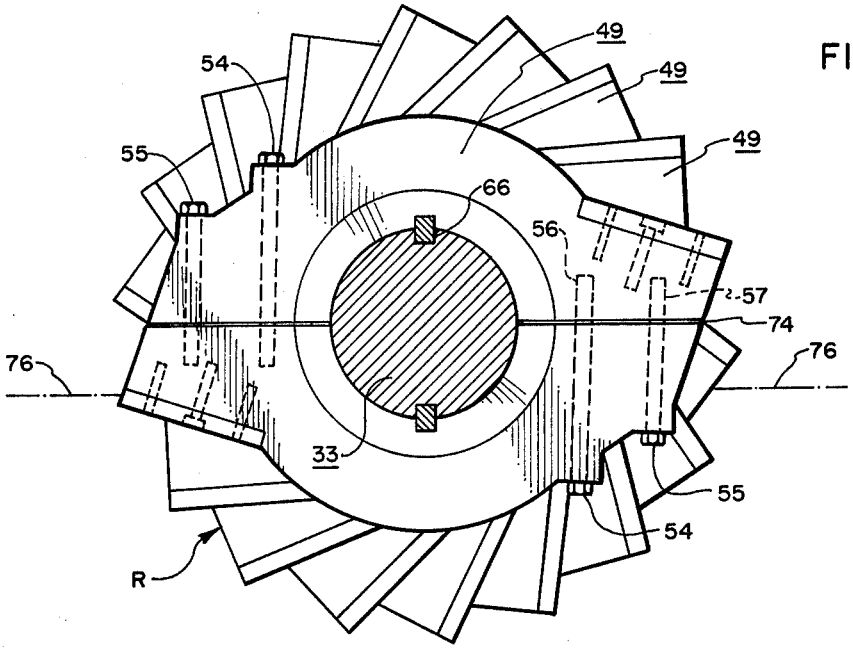
FIG. 8 is an end view of the shaft where all of the blades are mounted thereto.

FIG. 8 illustrates all of the blades assembled on the shaft in the respective grooves 48. It is noted that the blades are tightened down on the shaft securely and firmly, leaving perhaps a permissible space at 74. This provides sufficient clearance or tolerance so that there may be a firm securement of each blade-half pair, comprising respective blades 49, by the tightening of bolts 54 and 55 at opposite sides of the blade. It is noted that the blade configuration is such that two shearing cuts are had for each revolution of the blade. The inner peripheral margin 64, see FIG. 6, will be tapered such that there is an increase in dimension of perhaps 0.030 inches as to the slot at its entrance point, over the horizontal dimension of the slot at its base. Typically, there will be a depth of approximately one inch relative to each groove 48.

The bearings 38,39 may be bronze or other material, even steel where the Rockwell hardness of abutting surfaces is sufficiently high and their cooperating abutting surfaces lubricated.

Housing end walls or equivalent structure can be exactly positioned. The shaft can be exactly machined so as to provide a dimension between opposite surfaces 42 on a shaft, i.e. between end portions 34 and 35 of shaft 33. But to absolutely prevent the shifting of the shaft along its axis, so as to prevent misalignment between the blades and the spacer bars, hereinafter discussed, between which they pass, the surfaces 40,41 may be accurately machined, ground or lapped so that there will be no possibility of actual shifting of the shaft over perhaps one or two thousandths of an inch, or even less. Accordingly, extremely close tolerances can be held as between the revolving blades and their cooperating cutter bars. These cutter bars are indicated at 76 and 77, by way of example, and may be secured to the housing 13 or other structure in the same manner as that shown in the inventor's prior U.S. Pat. Nos. 3,893,635, 3,840,187, and 3,708,127. Thus, the configuration and support of these cutter bars will be the same as that shown in the aforementioned patents which are fully incorporated herein by reference. Such cutter bars may be supported by the housing sides 16 and 17, and bolt attachments as at 78 in FIG. 1 may be employed to effect this objective.

To complete the structure, a motor or other prime mover 79 is labeled as M in FIG. 1 and is coupled to a gear reducer 80, labeled GR. The gear reducer serves to reduce shaft revolvement of motor 79 and provide a high torque, low rpm drive to coupling 81. Unit 81 is an overload release coupling which of itself, standing alone, is a standard machine practice. The same may comprise respective hubs 82,83, provided with two or more shear pins 84; thus, upon overload, for example, where the shearing structure within housing 13 engages hard object such as a hard steel shaft, and is unable to shear the same, the overload release at coupling 81 comes into play. Shearpin type and other release couplings may be used at 81, are common in the art, and are shown for example at pages 15–18, 15–29 in Kent's Mechanical Engineers Handbook, 12th Edition, Wiley & Sons. Shaft 35 is coupled directly to hub 84 of coupling 81 as shown by the dotted line 85 seen in FIG. 1.

Figure 5:
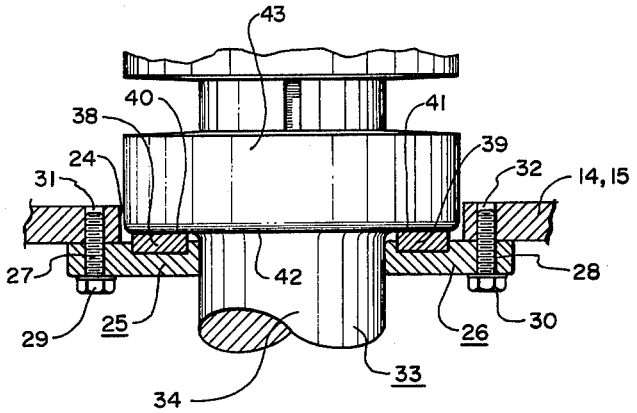
FIG. 5 is a horizontal section looking down and taken along the line 5—5 in FIG. 4; a corresponding view is had at the opposite housing end wall in FIG. 1 at the arrow 5—5.

In fabrication and assembly, the shaft 33 is accurately machined to provide the requisite grooves 48, turned-down end portions 34,35 and key recesses 65A. The shaft blades are provided with contoured, inwardly convex, keyways 65B and are mounted on the shaft, the rotor R is installed in the housing and the blades will proceed between the previously installed cutter bars at 76–77, for example. The bearings are secured at 44 and 45. However, there will be some lateral play in each of the bearings, and this even though tapered bearings are used, for example. Whatever the specific configuration of the bearings, the bearing support halves 25,26 are last installed, these with bearing halves 36 and 37. The bearing material at 38 and 39 in FIG. 5, are closely machined so that when the plates are tightened down there is an exact fit and proper bearing engagement between surface 42 and each end of the shaft and surfaces 40 and 41 relative to the bearing havles and each shaft end. The series of bolts 29 and 30 are tightened down at each end of the shaft so that the shaft is made secure against shift or movement along its axis. Again, the shape of the keys 65 and 67 as in FIG. 7 assures exact positionment of each of the blades as formed by blade halves 50,51.

To form the bearing material at 38 and 39 in FIG. 5, for example, the same may comprise simply a built-up bronze layer deposited by welding, with the outer surface being simply machined or ground down for an exact fit, as desired, as hereinbefore explained.

Figure 2:
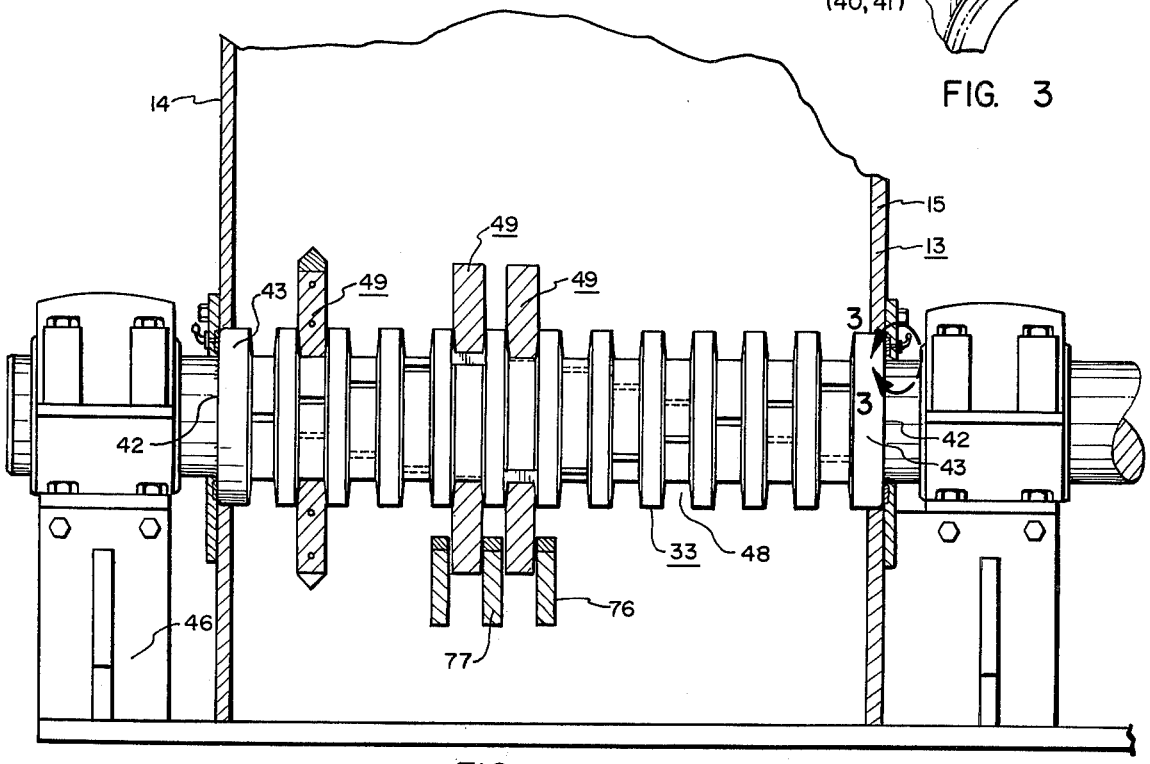
FIG. 2 is a view similar to FIG. 1, but with the shredder housing cut away to reveal the shredder shaft, and a representative blade and cutter bars associated therewith.

In operation, the rotor R including shaft 33 and blades 49 rapidly revolves, with the blades assuming a vertical travel path between adjacent cutter bars 76,77, for example in FIG. 2. Any debris falling upon or resting upon the cutter bars is sheared by the successive blades, these being arranged in helical fashion, for loading distribution. The shaft will not shift back and forth in this journal bearing since the opposite surfaces at 41,42 is carefully dimensioned and these surfaces held in place by the opposite bearing halves held in place by varying supports 25,26,36 and 37. Accordingly, extremely close tolerances including even metal-to-metal contact may be had as between the blades and the cutter bars, thereby ensuring a maximum effectiveness of the shredding or shearing operation. If there is an overload condition present in the machine, then the overload release coupling 81 comes into play so as to shear the pins at 84 and thus leave the machine undamaged. Shear pins at 84 are designed to shear and hence release substantially before any shearing of the blade keys would be chanced; hence, shearing pins 84, exterior of the machine, need only be replaced in the coupling for the machine to resume operation.

The above machine is very capable, owing to its precision nature, of performing very effectively in shearing a wide variety of materials.

The sloping annular sides of each groove 48 as seen in FIG. 6 provides for ease of insertion of each blade half into the groove 48 for securement by bolts 54 and 55. Where the key recesses 66 on shaft 33 are helically staggered, see FIGS. 6 and 8, so that these assume a helical configuration about the shaft, then the blade halves including the keyways may be fabricated in identical fashion; yet, the blades will be positioned in helical fashion as shown in FIG. 8. The tapered inner peripheral margins 64 of the blades, see FIG. 6, likewise permit an easy insertion of the blade halves and a mating cooperation thereof with the tapered-side grooves 48. While two blade halves or blade segments are preferred, it is possible that any plural number of segments can be employed to comprise each blade 49. Hardened steel segments, not shown, should always be supplied the cutter bars 76,77. It will be understood that blades or work members and the bed of stationary cutter bars or reaction members will extend in FIG. 2 throughout the entire length of housing 13. The subject invention is useful in a variety of contexts including any work member being supported on a shaft and being positively keyed thereto to ensure exact placement of such work member on a shaft. The essentially axially facing laterally outwardly extending surfaces, see 42 in FIG. 5 of the shaft, provides a sure bearing abutment with the bearing means 38,39. While conceivably a single means might be employed to fix the disposition of such surfaces 42 on the shaft, it is deemed preferable to have separate bearings perform this function. The key used to key each blade segment or blade half to the shaft is likewise important in this configuration, in ensuring exact placement of the blade means or work member on the shaft.

When key 65 is used in conjunction with U.S. Pat. Nos. 3,840,187; 3,893,635; 3,708,127; 3,951,346 and 3,762,655, it can be the only device that maintains in an exact manner the transverse and helix position of the blade means, at the hubs, if used, relative to the shaft; whereas in the present invention the keys are necessary to hold the blades in the helical position and work simply in conjunction with the shaft grooves, to maintain respective blade-transverse-position on the shaft.

While particular embodiments of the invention have been shown and described, it will be obvious to those skilled in the art the various changes and modifications which may be made without departing from the essential features of the present invention and, therefore, the aim in the appended claims is to cover all such changes and modifications as fall within the true spirit and scope of the invention.

I claim:

1. In combination, a rotor having a shaft of circular outer cross-section and provided with a series of mutually spaced, annular grooves, plural, mutually spaced blade means mounted upon said shaft and respectively disposed in said grooves, and wherein said grooves have side walls that diverge outwardly.

2. The combination of claim 1 wherein said grooves have inwardly uniformly sloping annular sides.

3. In combination, a rotor having a shaft of circular outer cross-section and provided with a series of mutually-spaced, annular grooves, plural, mutually-spaced blade means mounted upon said shaft and respectively disposed in said grooves, said grooves having side walls that diverge outwardly, and wherein each of said blade means includes inner peripheral margins having inwardly converging side walls cooperating with said grooves.

4. Materials reduction structure including, in combination: a bed of plural, mutually spaced reaction means; means for supporting said reaction means; a shaft; plural blade means mounted on said shaft and positioned for passage between selected ones of said reaction means; means for journaling said shaft transversely over said reaction means; and means separate from said journaling means for essentially maintaining said shaft and said blade means in predetermined position, whereby to essentially preclude a shifting of position of said shaft along its axis, and wherein said shaft includes axially facing laterally outwardly extending surfaces, said separate means comprising mutually-facing bearing means engaging opposite ones of said surfaces.

5. In combination, a housing having opposite end walls provided with shaft-passage, aligned apertures; a shaft carrying blade means disposed in and passing through said housing at said apertures; means for journalling said shaft for revolvement thereof, said shaft having a respective laterally outwardly extending surface proximate each of said housing end walls; plural bearing means respectively engaging said outwardly extending surfaces, respectively; and means mounted to opposite ones of said housing end walls for carrying said bearing means.

6. In combination, a shaft; means journalling said shaft for revolvement, said shaft having lateral bearing surfaces; a work member mounted upon said shaft; a stationary reaction member mounted proximate said work member for operative cooperation therewith; means for supporting said stationary member, and means independent of said journalling means engaging said bearing surfaces for constraining said shaft against movements along the shaft's axis.

7. A unitary, one-piece shaft key having parallel, opposite, side edges and outwardly extending, concave edge means having outwardly diverging edge sides for keying an external member to a shaft.

8. In combination, a work member having an interior keyway provided with a medial, inwardly extending convex portion; a journalled shaft having a positioning key recess; and a unitary, one-piece key seated in said shaft key recess and having an outer concave edge, defined by outwardly diverging edge sides, receiving said convex portion of said work member, whereby to hold said work member on said shaft at a predetermined position.

9. In combination, a revolving blade means comprising plural blade segments and having an interior keyway provided with a medial, inwardly extending convex portion; a journalled shaft having a positioning key recess; and a unitary, one-piece key seated in said shaft key recess and having an outer concave edge receiving said convex portion of said revolving blade means, whereby to hold said revolving blade means on said shaft at a predetermined position.

* * * * *